United States Patent [19]

Nakajima

[11] Patent Number: 4,617,899

[45] Date of Patent: Oct. 21, 1986

[54] FUEL INJECTION CONTROL DEVICE FOR INTERNAL COMBUSTION ENGINE

[75] Inventor: Tetsuo Nakajima, Saitama, Japan

[73] Assignee: Honda Giken Kogyo Kabushiki Kaisha, Tokyo, Japan

[21] Appl. No.: 728,979

[22] Filed: Apr. 30, 1985

[30] Foreign Application Priority Data

Jun. 4, 1984 [JP] Japan ..... 59-113094

[51] Int. Cl.[4] ..... F02D 41/34

[52] U.S. Cl. ..... 123/487; 123/480; 364/431.05

[58] Field of Search ..... 123/478, 480, 486, 487, 123/490; 364/431.05

[56] References Cited

U.S. PATENT DOCUMENTS 3,855,973 12/1974 Scofield ..... 123/490

FOREIGN PATENT DOCUMENTS 108423 7/1982 Japan ..... 123/490
158329 9/1983 Japan ..... 123/490
158328 9/1983 Japan ..... 123/490
2129164 5/1984 United Kingdom ..... 123/480

*Primary Examiner*—Tony M. Argenbright

*Attorney, Agent, or Firm*—Pollock, Vande Sande & Priddy

[57] ABSTRACT

A fuel injection control device for an internal combustion engine, which enables injection of fuel into separate cylinders to be controlled by only one timer counter, without reference to the number of cylinders, thereby simplifies the configuration of an electronic circuit for the control of the internal combustion engine, and promotes reduction of cost and improvement of reliability. A timer counter constantly takes count of clock pulses, a register is set to a first preset value which is a sum of a count value existing in said timer counter and a value corresponding to an expected delay time upon occurrence of a top dead center signal, and, subsequent to occurrence of an injection start signal, the register is set to a second preset value produced by addition of said actual fuel injection time signal to said first preset value, a comparator generates an injection start signal when a count value in the timer counter is equal to the first preset value in said register and generates an injection stop signal when said count value is equal to said second preset value, and one of the injectors for receiving said injection start and injection stop signals is selected and designated based on an injection discriminating signal and a top dead center signal.

4 Claims, 9 Drawing Figures

FIG. 3A
FIG. 3
PRIOR ART
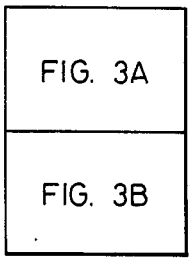
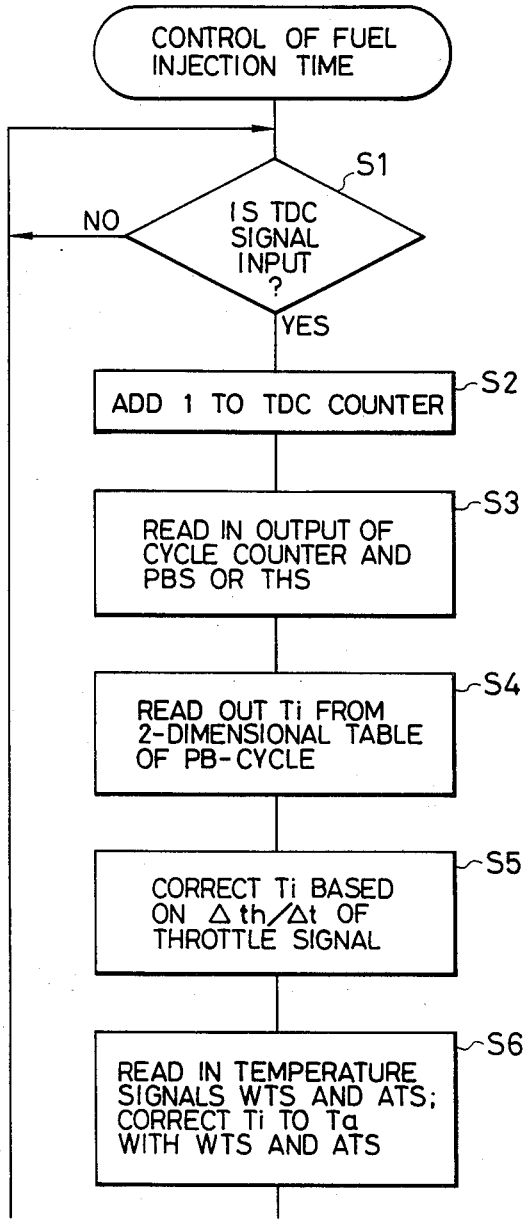

FUEL INJECTION CONTROL DEVICE FOR INTERNAL COMBUSTION ENGINE

BACKGROUND OF THE INVENTION (1) Field of the Invention

This invention relates to a fuel injection control device for an internal combustion engine, and more particularly to such a fuel injection control device which enables injection of fuel into separate cylinders to be controlled by one timer, without reference to the number of cylinders, thereby simplifying the configuration of an electronic circuit for the control of the internal combustion engine, reducing cost, and improving reliability.

(2) Description of the Prior Art

FIG. 1 is a block diagram schematically illustrating the structure of a conventional fuel injection control device for an internal combustion engine, FIG. 2 is a time chart for describing the operation of the fuel injection control device shown in FIG. 1, and FIG. 3 is a flow chart for describing the operation of a computer (hereinafter referred to as "CPU") part of the device of FIG. 1. In the diagram of FIG. 1, the input and output interfaces are omitted.

A top dead center (TDC) signal for any of the cylinders is issued when the piston of that particular cylinder is substantially at the top dead center thereof. It serves to indicate the standard timing for starting the fuel injection for the cylinder.

A fuel injection discriminating signal IIS is issued whenever one cycle of fuel injection for all cylinders is completed. This signal is given out after every second rotation of the crank.

The top dead center signal TDC is given a definite shape in a waveform shaper 10 and then supplied to a cycle counter 14 and a CPU 20. The injection discriminating signal IIS is given a definite shape in a waveform shaper 11 and then supplied to the set terminal of a flip-flop 12.

The flip-flop 12 functions as an injection discriminating flag. The Q output from the flip-flop 12 is supplied to the CPU 20.

A PB sensor signal PBS, a throttle signal THS, a water temperature signal WTS, and an air temperature signal ATS are invariably supplied to a multiplexer 16, converted into digital signals in an A/D converter 18 in accordance with selection commands from the CPU, and then taken into the aforementioned CPU 20.

A read only memory (ROM) 21 is used to store programs for the CPU 20, and a random access memory (RAM) 22 stores data for arithmetic operations and results of the arithmetic operations. Plainly, the output of the cycle counter 14, i.e. the interval between the successive top dead center signals TDC or the cycle of the top dead center signal TDC, corresponds to the revolution number of the engine. By the well-known method using the output of the cycle counter 14, the PB sensor signal PBS, or the throttle signal THS, therefore, a basic fuel injection time signal Ti can be read out of a table, for example.

The basic fuel injection time signal Ti is corrected into an actual fuel injection time signal Ta by the well-known technique using the water temperature signal WTS and the air temperature signal ATS, for example.

The CPU 20 selects the particular one of the injectors to be controlled as described fully afterward in accordance with the timings of occurrence of the top dead center signal TDC and the injection discriminating signal IIS and supplies the output (actual fuel injection time signal Ta) to the corresponding one of #1 through #4 timer counters, 31 through 34.

The timer counter to which the output corresponding to the actual fuel injection time signal has been supplied by the CPU 20 feeds a drive signal to the corresponding one of the #1 through #4 drivers, 41 through 44 and, at the same time, starts clocking the time.

The aforementioned driver is stopped after the time fixed by the aforementioned actual fuel injection time signal Ta has elapsed.

In the manner described above, the control over each of the injectors, namely the control of the fuel fed to the corresponding cylinder, is carried out.

Now, the operation of the CPU 20 will be described with reference to FIG. 3.

Step S1—This step discriminates between the presence and the absence of the input of the top dead center signal TDC.

Step S2—This step adds 1 to the value in the TDC counter when the presence of the input of the top dead center signal TDC is found in step S1.

Step S3—This step reads in the output of the cycle counter 14 and the PB sensor signal PBS or the throttle signal THS.

Step S4—This step, based on the data read in through the preceding step, reads out the basic fuel injection time signal Ti from a two dimensional table by using the output of the cycle counter 14 and the PB sensor signal PBS, for example, as parameters.

Step S5—This step discriminates the state of acceleration or deceleration based on the ratio of change of the throttle signal THS, i.e. $\Delta th/\Delta t$, and corrects the aforementioned basic fuel injection time signal Ti by a proper known technique using the outcome of the discrimination.

Step S6—This step reads in the water temperature signal WTS and the air temperature signal ATS, for example, through the multiplexer 16 and the A/D converter 18 and corrects the aforementioned signal Ti by a proper known technique in accordance with the values of such signals. The outcome of this step is the actual fuel injection time signal Ta.

Step S7—This step determines whether the flip-flop (injection discriminating flag ) 12 is set or not. When the flip-flop is set, the operation proceeds to step S8. However, when the flip-flop is not set, the operation proceeds to step S9.

Step S8—This step resets the flip-flop (injection discriminating flag ) 12 and, based on the actual injection time signal Ta found previously by calculation, energizes the #1 timer counter 31 and causes the fuel to be supplied in a stated amount to the first cylinder by the operation of the #1 driver 41 and the #1 injector 51.

In FIG. 1, the #1 timer counter 31 is depicted as formed in one block. Actually, however, it is composed of a register for memorizing the actual fuel injection time signal Ta mentioned above, a timer for clocking time in accordance with the start signal from the CPU 20, and a comparator for comparing the memorized signal of the aforementioned register and the counted value of the aforementioned timer. The #1 driver 41 is energized by the start of the aforementioned timer to open the #1 injector 51. When the comparator produces its output, the #1 driver is deenergized so as to close the valve of the #1 injector 51.

The operation described above exactly applies to each of the other timers 32–34.

Step S9—This step determines whether the value of count in the TDC counter is 2 or not.

Step S10—This step energizes the #2 timer counter 32 and causes injection of the fuel in a stated amount through the #2 injector 52, based on the actual injection time signal Ta found by calculation in preceding step S6.

Step S11—This step determines whether the value of count in the TDC counter is 3 or not.

Step S12—This step energizes the #3 timer counter 33 and causes injection of the fuel in a stated amount through the #3 injector 53, based on the actual injection time signal Ta found by calculation in preceding step S6.

Step S13—This step energizes the timer counter #4, 34 and causes the fuel to be supplied in a stated amount through the #4 injector 54, based on the actual injection time signal Ta found by calculation in preceding step S6.

Step S14—This step resets the TDC counter and returns the operation to step S1.

In accordance with the fuel injection control device for the internal combustion engine illustrated in FIG. 1, the optimum injection time or the optimum amount of fuel to be injected is calculated for each of the cylinders of the internal combustion engine at every optimum time to efect sequential fuel injection at the optimum timing as described above.

The sequential fuel injection effected in this manner, as viewed in terms of the demand made by the engine, proves to be the most desirable method for the control of fuel injection.

This method requires all the cylinders of the internal combustion engine to be severally served by timer counter circuits, e.g. at least four timer counter circuits in the case of a four-cylinder engine, so that fuel injection signals will be issued one each for all the cylinders. It, therefore, entails a disadvantage that the electric control circuit is so complicated in configuration as to induce addition to cost and reduction in reliability of performance.

Further when the internal combustion engine is operated under the condition of a heavy load, the aforementioned merit of and the necessity for the sequential control are diminished because the fuel injection times are proportionally elongated.

SUMMARY OF THE INVENTION

An object of this invention is to provide a fuel injection control device for an internal combustion engine, and more particularly to a fuel injection control device which enables injection of fuel into separate cylinders to be controlled by only one timer, without reference to the number of cylinders, thereby simplify the configuration of an electronic circuit for the control of the internal combustion engine, and promote reduction of cost and improvement of reliability.

BRIEF DESCRIPTION OF THE DRAWINGS

FIGS. 3, 3A and 3B are a flow chart illustrating the operation of the computer (CPU) part of the device of FIG. 1.

DETAILED DESCRIPTION OF THE INVENTION

Figure 1:
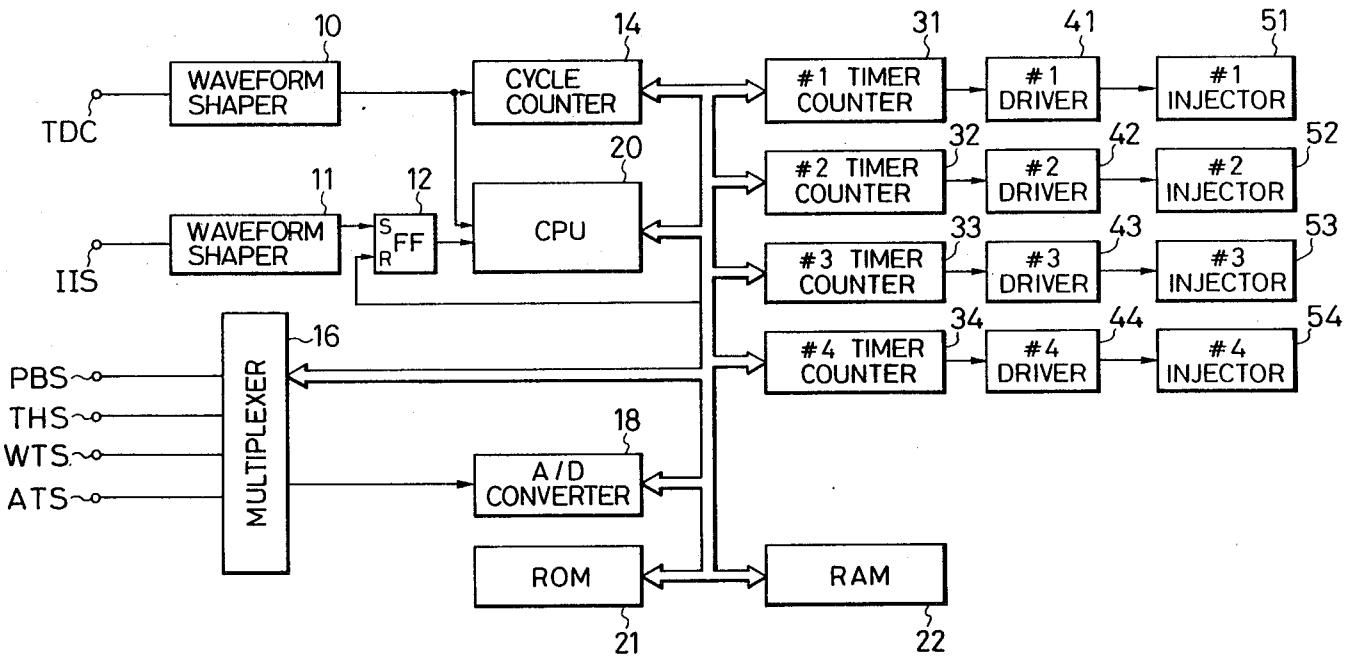
FIG. 1 PRIOR ART
FIG. 1 is a block diagram schematically illustrating the structure of a conventional fuel injection control device for an internal combustion engine.
Figure 2:
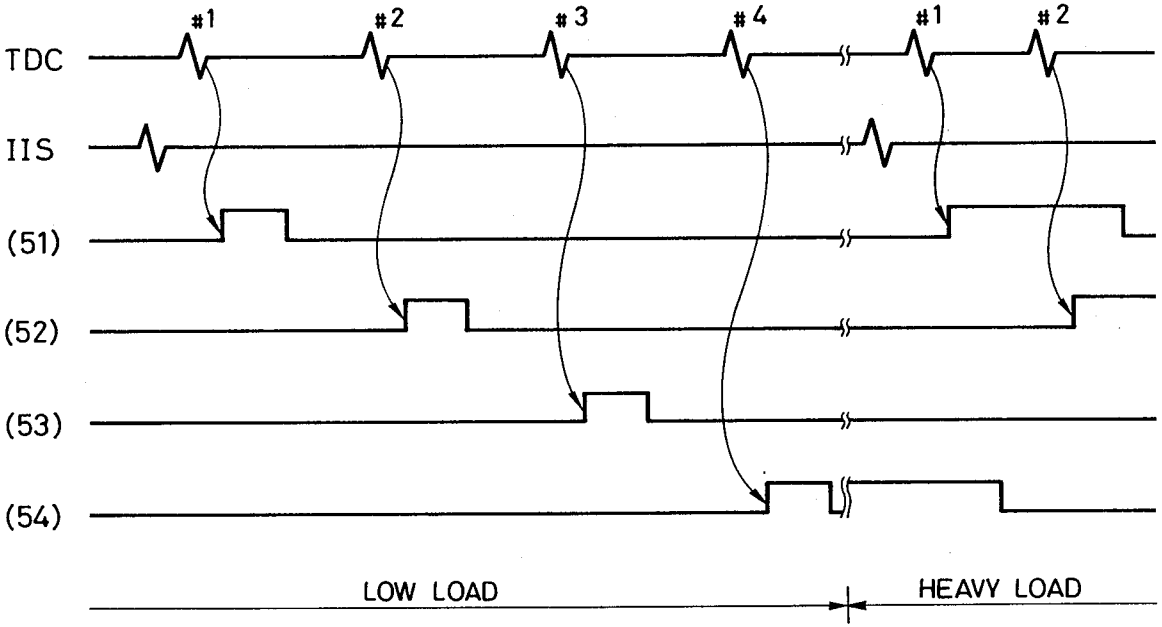
FIG. 2 PRIOR ART
FIG. 2 is a time chart describing the operation of the device shown in FIG. 1.
Figure 3B:
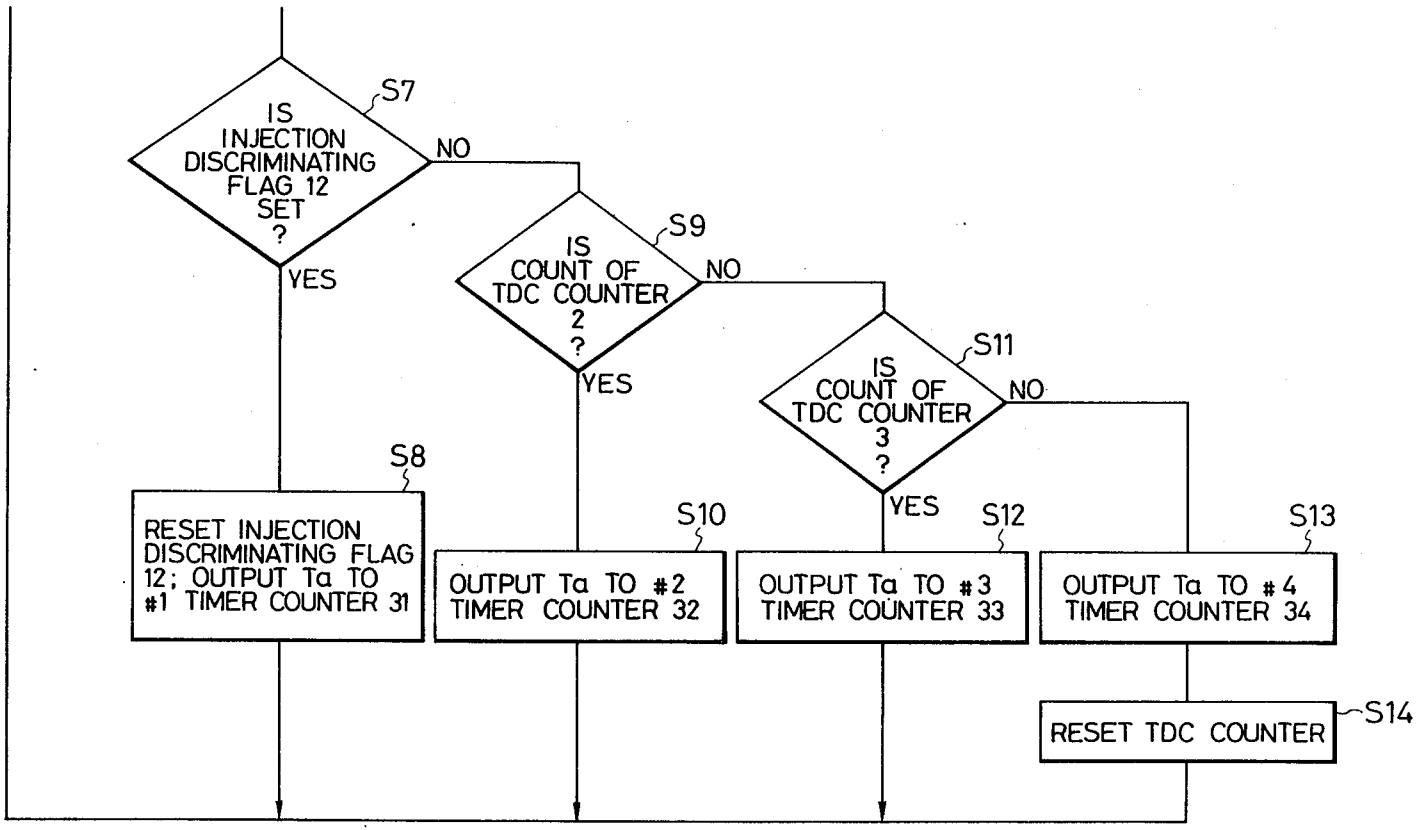
Figure 4:
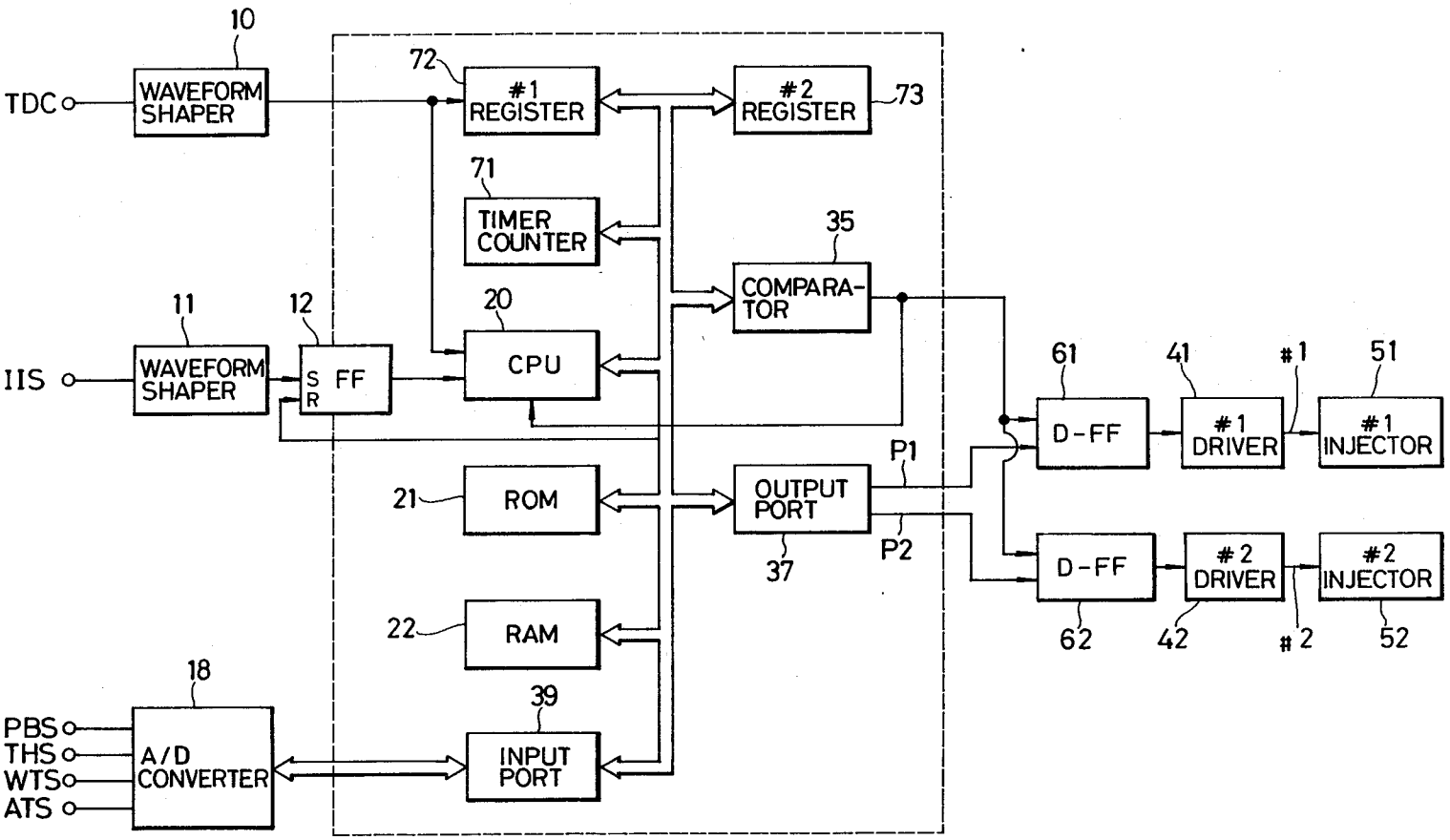
FIG. 4 is a block diagram schematically illustrating one preferred embodiment of the present invention.
Figure 5:
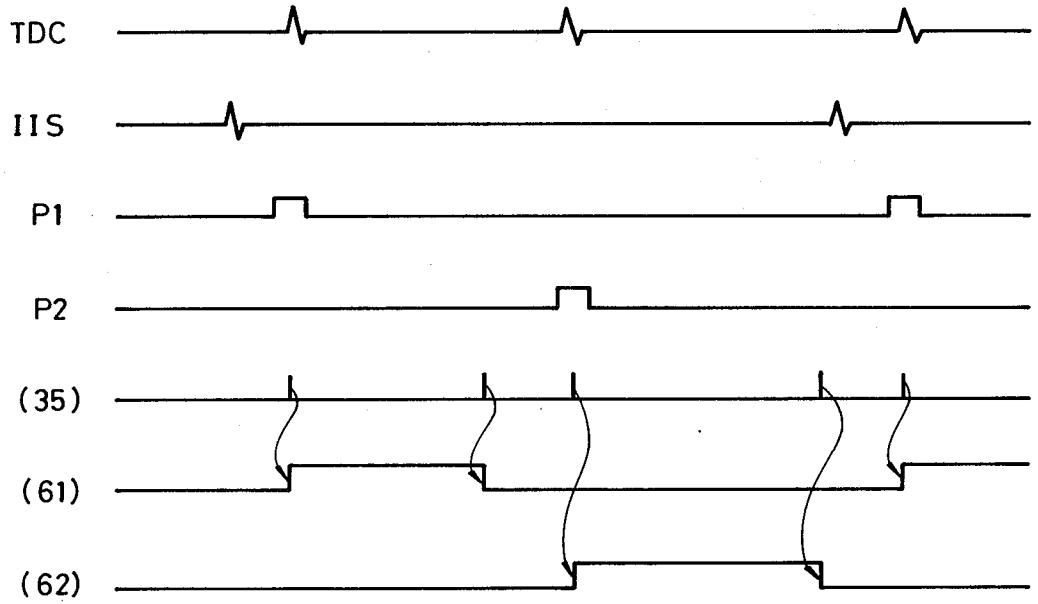
FIG. 5 is a time chart for illustrating the operation of the embodiment of FIG. 4.

In FIG. 4, the input and output interfaces are omitted. In FIGS. 4 and 5, the same numerical symbols as found in FIGS. 1 through 3 denote identical or equivalent component parts.

FIGS. 4 through 7 depict this invention as embodied with respect to a two-cylinder engine. It will be readily understood by persons skilled in the art that this invention is similarly applicable to other engines with a different number of cylinders.

With reference to FIG. 4, whenever a TDC signal is generated, CPU 20 causes a count value $T_p0$ appearing at that time in a timer counter 71 to be memorized in #1 register 72. Incidentally at that time, #2 register 73 is keeping in memory a count value $T_p1$ of the timer count 71 at the time when the immediately preceding TDC signal was generated.

The difference (cycle) $T_p$ obtained by subtracting the content of #1 register 72 from the content of #2 register 73 represents the revolution number of the engine.

After the difference (cycle) $T_p$ has been computed by the aforementioned subtraction, the content $T_p0$ stored in #1 register 72 is transferred to #2 register 73 to be stored as a new $T_p1$ therein.

Then, a PB sensor signal PBS is read in via an A/D converter 18 and an input port 39. A basic fuel injection time Ti based on the aforementioned cycle $T_p$ and the PB sensor signal PBS as parameters thereof, for example, is then read out of a table prepared in advance or computed by a prescribed computation.

Further, a throttle signal THS, a water-temperature signal WTS, and a intake air temperature signal ATS are read in to effect temperature compensation and acceleration/deceleration compensation by a well-known process upon the aforementioned basic fuel injection time Ti,for calculating an actual fuel injection time signal Ta.

Then, the TDC signal detected previously is examined to determine whether or not it is a first TDC signal since the generation of an IIS signal (which determination yields an affirmative or negative result depending on whether or not the flipflop 12 is set). When the answer is in the affirmative, #1 output P1 from the output port 37 is caused to generate a pulse.

When the answer is in the negative, #2 output P2 from the output port 37 is caused to generate a pulse.

At the same time, a value which is the sum of the current count value T0 of the timer counter 71 and an injection delay time $T\alpha$ is set in #1 register 72. In the comparator 35, the value ($T0+T\alpha$) stored in #1 register 72 and the count value in the timer counter 71 are compared with each other.

When the two values are equal, the comparator 35 feeds out an output "1" and transfers an interrupt signal to the CPU 20. The aforementioned output "1" is also applied to the clock terminals of D-flipflops 61, 62.

At this time, a signal "1" has already been supplied to the D input terminal of either of D-flipflops 61, 62 as already described. As the result, the D-flipflop on which the signal "1" has been applied is set and, consequently, a corresponding driver 41 or 42 is driven to cause an injector 51 or 52 to start fuel injection into a relevant cylinder.

In response to detection of the aforementioned equality signal, the pulse from the output port 37 is extinguished and, in #1 register 72, a value which is the sum of the existing set value (T0+Tα) and the aforementioned actual fuel injection time signal Ta is set anew.

The comparator 35, therefore, feeds out an equality signal again after elapse of the prescribed duration of the actual fuel injection time signal Ta from the aforementioned start of fuel injection, in other words after injection of a prescribed amount of fuel has been completed.

Since the output from the output port 37 has already been extinguished (namely, reduced to "1") by this time, the relevant D-flipflop 61 or 62 is reset, the driver is inactivated, and the fuel injection by the injector ceases.

Since pulses are alternately issued to the #1 and #2 output terminals P1, P2 from the output port 37 as described above, the fuel injection is effected alternately in amounts determined by the aforementioned calculation to the individual cylinders of the two-cylinder engine.

Figure 6:
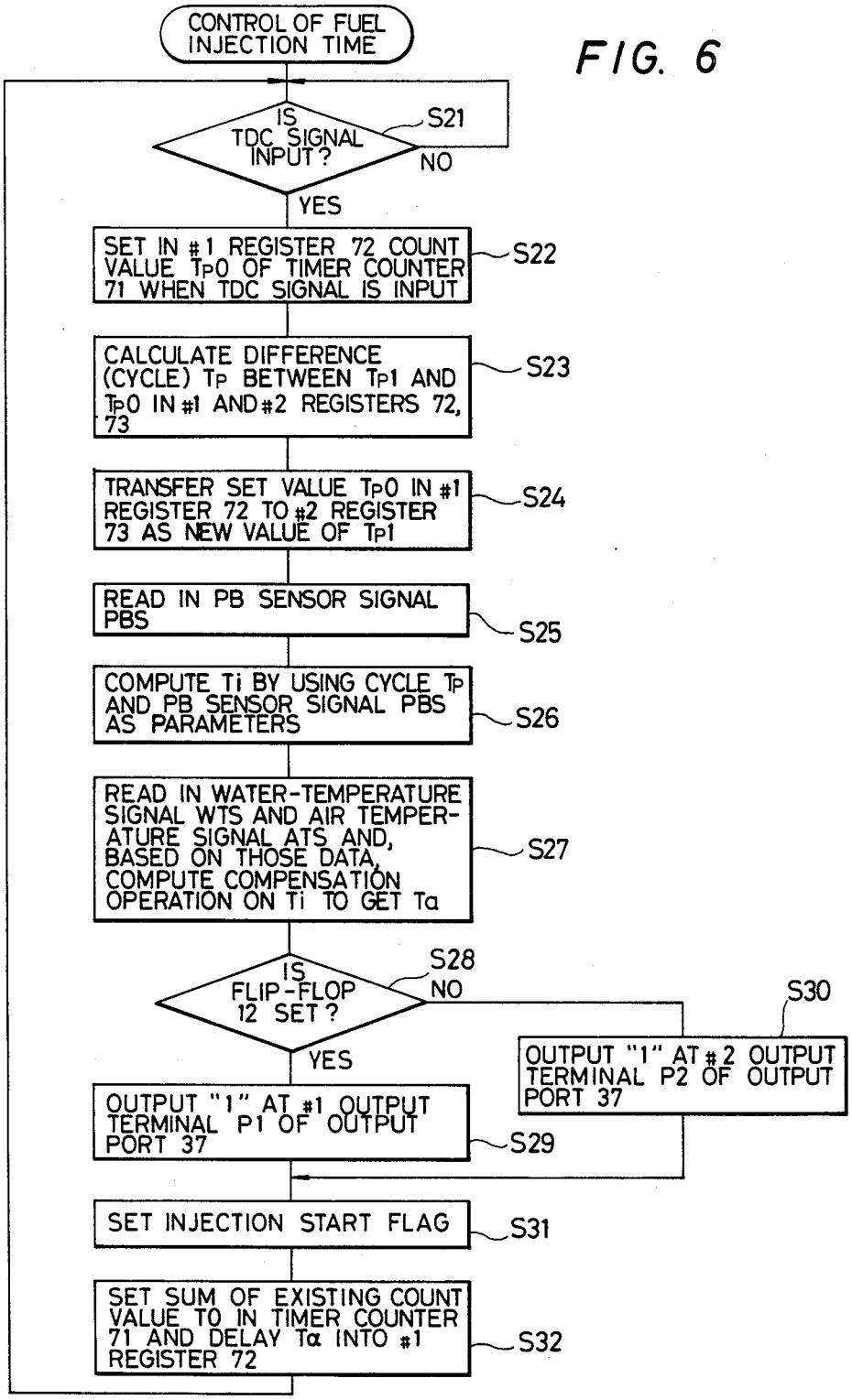
FIG. 6 and FIG. 7 are flow charts for illustrating the operation of the computer (CPU) part in the embodiment of FIG. 4.

Now, the operation of the CPU 20 depicted in FIG. 4 will be described in further detail below with reference to FIG. 6 and FIG. 7.

Step S21—It is decided whether a TDC signal is supplied or not.

Step S22—The count value $T_p0$, appearing in the timer counter 71 at time when the TDC signal is supplied, is stored in the #1 register 72.

Step S23—The difference between the value $T_p0$ registered in the #1 register 72 according to the proceding step S22 and the value $T_p1$ set in the #2 register 73 at that time, in other words, the cycle $T_p$ is computed. Said value $T_p1$ is set in the #2 register 73, as described later, in the step S24.

Step S24—The set value $T_p0$ in the #1 resister 72 is transferred as a new value of $T_p1$ to the #2 register 73 to be set there.

Step S25—The PB sensor signal PBS is read in via the A/D converter 18 and the input port 39.

Step S26—The basic fuel injection time signal Ti is read out of the table or determined by calculation by using as parameters therefor the cycle $T_p$ and the PB sensor signal PBS obtained in the preceding steps S23 and S25.

Step S27—The water-temperature signal WTS and the intake air temperature ATS are read in and, based on these data, the computation for compensation is effected to alter the basic fuel injection time signal Ti found in the preceding step into the actual fuel injection time signal Ta.

Step S28—The determination is made whether the flipflop 12 is set or not. The processing is advanced to Step 29 when the flipflop 12 is set, and to Step 30 when the flipflop 12 is not set.

Step S29—The #1 output terminal P1 of the output port 37 produces "1" as an output.

Step S30—The #2 output terminal P2 of the output port 37 produces "1" as an output.

Step S31—The injection start flag is set up.

Step S32—The value which is the sum of the existing count value T0 in the timer counter 71 and the expected delay time Tα is set in the #1 register 72. Then, the processing is returned to the first step, S21.

In the meantime, the comparator 35 continues monitoring the value set in the #1 register 72 and the count value in the timer counter 71 for their equality and, when they are equal, feeds out an output and applies an interrupt on the CPU 20.

Figure 7:
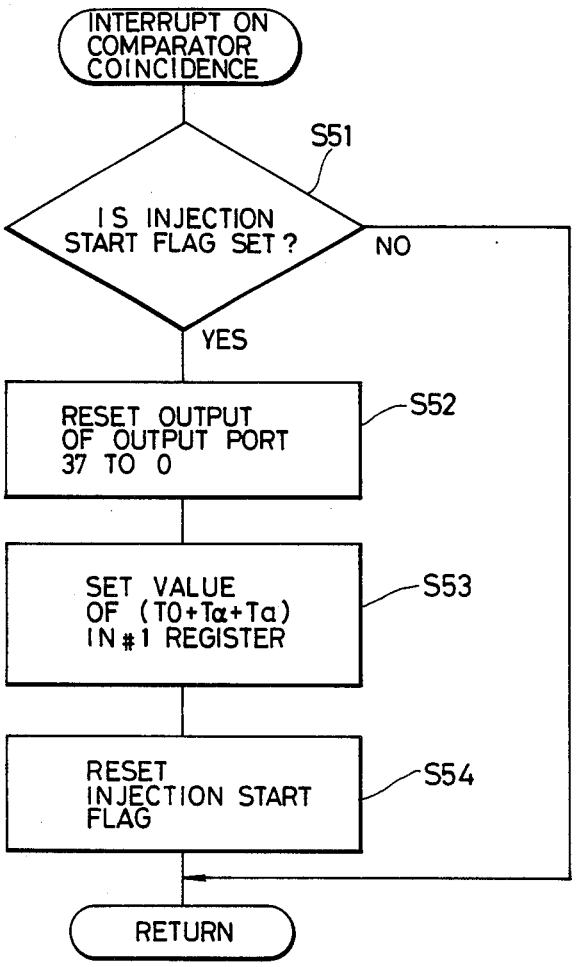

FIG. 7 portrays the operation of the CPU 20 which occurs when the comparator 35 feeds out an equality output and applies an interrupt upon the CPU 20.

Step S51—The determination is made as to whether the injection start flag is set or not. When the flag is set, since it is implied that the fuel injection is on the verge of starting, the processing is advanced to Step S52. When the injection start flag is not set up, since it is implied that the fuel injection is on the verge of being completed, the processing is returned to the main program.

Step S52—The fact that the injection start flag is set up is an indication that the signal "1" emerges as an output at either of the #1 and #2 output terminals of the output port 37. When the comparator 35 generates an equality output, therefore, this output is fed to the clock terminals of the D-flipflops 61, 62. As the result, the flipflop to which the aforementioned output "1" is supplied is set. In consequence of the aforementioned setting of the flipflop, the corresponding driver and injector effect injection of fuel. In this step S52, the output of the output port 37 is set to 0.

Step S53—The value which is the sum of the existing set value (T0+Tα) in the #1 register 72 and the actual fuel injection time signal Ta is set anew.

Step S54—The injection start flag is reset.

Owing to the processing described above, the count value of the timer counter 71 is again equalized with the set value of the #1 register 72 after elapse of the actual fuel injection time signal Ta from the aforementioned start of fuel injection. As the result, the comparator 35 again generates an equality output to apply an interrupt upon the CPU 20.

At the step S51 during the latter interruption, the CPU 20 effects no processing because the injection start flag is not set. Thus, the processing is returned to the main program.

On the other hand, since the output of the output port 37 is now reset to "0," the flipflop which has been set so far is reset when the equality output of the comparator is fed to the clock terminal of the flipflop. In consequence of the resetting, the operations of the corresponding driver and injector for fuel injection are brought to a stop.

It will be plain to any person of ordinary skill in the art that application of the present invention to an N-cylinder engine is attained by simply giving the foregoing operation an alteration indicated herein below with reference to FIG. 4.

(1) The number of output terminals of the output port 37 is increased to N and a D-flipflop, a driver, and an injector are connected to each of the N output terminals.

(2) A TDC counter for taking count of TDC signals is additionally incorporated, so that required selection of one of the output terminals of the aforementioned output port 37 is effected on the basis of the count value of the new TDC counter.

(3) The aforementioned TDC signal counter is reset by the IIS signal.

As is clear from the foregoing description, the present invention attains the following effect.

Since control of injection of fuel into separate cylinders is enabled to be effected by the use of only one timer, without reference to the number of cylinders, this invention simplifies the configuration of an electronic circuit for the control of the internal combustion engine and promotes reduction of cost and improvement of reliability.

What is claimed is:

1. A fuel injection control device for an internal combustion engine, comprising means for generating a basic fuel injection time signal based on at least one signal selected from among a signal representing the revolution number of an engine, a PB sensor signal, and a throttle signal, means for generating an actual fuel injection time signal by compensating said basic fuel injection time signal based on at least one signal selected from among an engine temperature signal and an intake air temperature signal, and means for controlling durations of keeping open the valves of injectors, provided for the separate cylinders of the internal combustion engine, based on said actual fuel injection time signal thereby controlling the amounts of fuel injected into said separate cylinders, which device is further provided with means for detecting a top dead center signal and an injection discriminating signal, means for computing a signal representing a revolution number of the engine based on said top dead center signal, a timer counter for constantly taking count of clock pulses, a register adapted to permit setting therein of a first present value produced, upon occurrence of a top dead center signal, by addition of a count value existing then in said timer counter to a value corresponding to an expected delay time and, subsequent to occurrence of an injection start signal, to permit setting therein of a second preset value produced by addition of said actual fuel injection time signal to said first preset value, a comparator adatped to feed out an injection start signal when a count value in said timer counter is equalized with said first preset value in said register and feed out an injection stop signal when said count value in said timer counter is equalized with said second preset value in said register, and means for selecting and designating an injector for receiving said injection start and injection stop signals based on said injection discriminating signal and said top dead center signal.

2. A fuel injection control device for an internal combustion engine according to claim 1, wherein said means for computing said signal representing said revolution number of engine comprises a second register for memorizing a count value of said timer count at the time of occurrence of an immediately preceding top dead center signal, and means for determining the difference between the memorized value of said second register and a count value of said timer counter existing at the time of occurrence of the present top dead center signal.

3. A fuel injection control device for an internal combustion engine according to claim 1, wherein said injection start and injection stop signals are supplied in common to clock terminals of D-flipflops provided severally for separate cylinders of said internal combustion engine, a driver and an injector are connected to each of the outputs of said D-flipflops, and signals for selecting and designating injectors are supplied in a prescribed sequence to the D input terminals of said D-flipflops.

4. A fuel injection control device for an internal combustion engine according to claim 2, wherein said injection start and injection stop signals are supplied in common to clock terminals of D-flipflops provided severally for separate cylinders of said internal combustion engine, a driver and an injector are connected to each of the outputs of said D-flipflops, and signals for selecting and designating injectors are supplied in a prescribed sequence to the D input terminals of said D-flipflops.

* * * * *